US007762426B2

(12) United States Patent
Stevens et al.

(10) Patent No.: US 7,762,426 B2
(45) Date of Patent: Jul. 27, 2010

(54) SEAL FOR DISPENSING CONTAINER HAVING DISPENSING OPENING

(75) Inventors: John Boyet Stevens, Mason, OH (US); David Tekamp, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 327 days.

(21) Appl. No.: 11/377,787

(22) Filed: Mar. 16, 2006

(65) Prior Publication Data

US 2007/0215633 A1 Sep. 20, 2007

(51) Int. Cl.
*A47F 1/04* (2006.01)

(52) U.S. Cl. ..... 221/154; 221/306; 221/312 C

(58) Field of Classification Search ..... 221/63, 221/197, 46, 49
See application file for complete search history.

(56) References Cited

U.S. PATENT DOCUMENTS 3,002,668 A * 10/1961 Castelli ..... 225/52
3,710,977 A * 1/1973 Van den Enden et al. ... 221/102
3,986,479 A * 10/1976 Bonk ..... 118/506
4,353,480 A * 10/1982 McFadyen ..... 221/63
4,733,794 A * 3/1988 Kent ..... 220/826
4,779,756 A * 10/1988 Buelens et al. ..... 220/839
5,050,737 A * 9/1991 Joslyn et al. ..... 206/494
5,139,165 A * 8/1992 Hara ..... 220/835
5,223,265 A * 6/1993 Wong ..... 424/473
5,542,566 A * 8/1996 Glaug et al. ..... 221/48
5,971,142 A * 10/1999 Jones ..... 206/233
D480,561 S * 10/2003 Simon et al. ..... D3/294
6,761,279 B1 * 7/2004 Martin et al. ..... 220/258.2
6,923,333 B2 * 8/2005 Arciniegas et al. ..... 215/251
2002/0170841 A1 * 11/2002 Persson ..... 206/440
2004/0159661 A1 * 8/2004 Aochi ..... 220/264
2004/0159666 A1 * 8/2004 Bucholtz ..... 220/839
2004/0232026 A1 * 11/2004 Goeking et al. ..... 206/459.1
2005/0205593 A1 * 9/2005 Young et al. ..... 221/33
2006/0027593 A1 * 2/2006 Slocum ..... 221/232
2006/0180596 A1 * 8/2006 Young et al. ..... 221/63
2007/0102442 A1 * 5/2007 Norris et al. ..... 221/197

FOREIGN PATENT DOCUMENTS

GB 1 311 617 3/1973

* cited by examiner

*Primary Examiner*—Gene Crawford
*Assistant Examiner*—Kelvin L Randall, Jr.
(74) *Attorney, Agent, or Firm*—Larry L. Huston; Leonard W. Lewis; Steven W. Miller

(57) ABSTRACT

A package having a dispensing opening. The opening has a periphery. The package and or opening periphery may have a non-circular cross section. The opening is covered by a removable lid, having an interference fit. The amount of interference varies around the periphery of the opening.

19 Claims, 6 Drawing Sheets

SEAL FOR DISPENSING CONTAINER HAVING DISPENSING OPENING

FIELD OF THE INVENTION

The present invention relates to dispensing of discrete sheets and more particularly to dispensing of discrete sheets from a container having an orifice.

BACKGROUND OF THE INVENTION

Dispensing of sheets from a container has long been done in the art. Reach-in dispensing allows multiple sheets to be dispensed at once, but can be inconvenient.

Pop-up dispensing is more convenient, but often dictates that a more vertically oriented package be used. If the sheets are wet, the package must have a lid, to prevent undue evaporation. A seal is formed between the lid and the body of the package.

If the seal does not have approximately equi-axed stresses, the seal may not fit tightly and evaporation may again result. This problem has been approached by using packages having a round seal and often a round cross section. However, this approach is not entirely successful. The consumer may desire a cross section having a different shape or footprint, more readily allowing indicia to be placed on a side wall of the package. Furthermore, the dispensing opening, and hence seal may not be round in such a package.

If a package with a non-circular cross section is selected, dispensing discrete sheets may present particular challenges. If the sheets are disposed in a plane generally perpendicular to the opening, an unduly large footprint may be required. If the sheets are packaged too tightly, tearing of the first few sheets to be dispensed may occur. The sheet may not easily unfold upon dispensing, particular if the sheet has cohesive forces due to wetting.

The need for improved dispensing and for improved dispensing packages continues. This need occurs with wet and dry sheets, which are both disposable and reusable.

SUMMARY OF THE INVENTION

The invention comprises a package. The package comprises a container having a body for containing a product therein. The body has an opening defined by a periphery. In one embodiment, a lid may be hingedly attached to the body, the lid being openable and closable by articulation of at least one hinge. The lid has an interference fit with said body, wherein one can fit inside the other to effect a seal. The interference fit is of a first dimension substantially throughout a first portion of said periphery not corresponding to the hinge. The interference fit is of a second dimension substantially throughout a second portion of said periphery corresponding to said hinges. The second dimension is less than said first dimension, whereby said seal extends substantially around the periphery upon closing said lid.

DETAILED DESCRIPTION OF THE INVENTION

Figure 1:
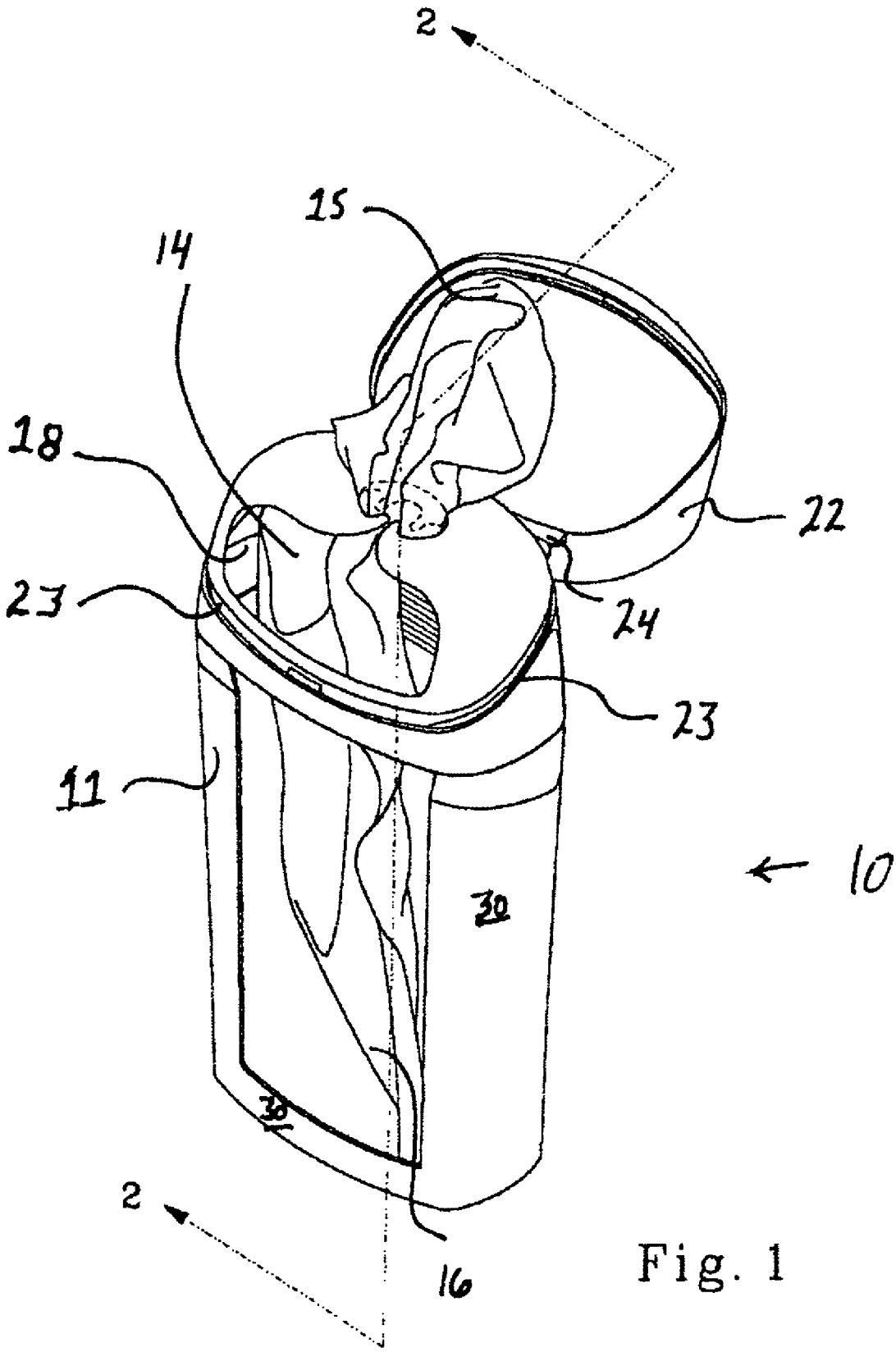
FIG. 1 is a perspective view, shown partially in cutaway, of an exemplary package, according to the present invention having a hinged lid in an open position.

Referring to FIG. 1, the package 10 according to the present invention may comprise a body 11. The package 10 may or may not have one or more articles placed therein. The articles are received in the body 11 of the package 10. The package 10 may have defined walls, may be generally parallelepipedly shaped, and may have a dispensing opening 18 therein. A lid 22 may be provided to cover the opening 18 and close the package 10.

If one or more articles are placed in the package, the articles may be dry, moist, wet or a combination thereof. The articles to be placed in the package 10 may comprise sheets 14, or may be other contents as desired.

Examining the package 10 in more detail, it may have defined walls 30. The walls 30 may define a top, a bottom, front and back sides, and left and right sides. The walls 30 of the body 11 and lid 22 may be generally coextensive when the lid 22 is in the closed position. Alternatively, the lid 22 may have a very different shape than the body 11.

The walls 30 of the package 10 need not be freestanding and rigid as depicted, but instead may be flaccid or resiliently deformable. This arrangement may provide a package 10 with an amorphous shape. Material such as polyethylene film may be suitable if flaccid walls are selected for the package 10. If so, a suitable package 10 may be made in accordance with the teachings of commonly assigned U.S. Pat. No. 5,379,897 issued Jan. 10, 1995 to Muckenfuhs et al. The package 10 may also be lightweight. By "lightweight" it is meant the package 10 is conveniently portable and does not have dead weight specifically added thereto. Alternatively, the walls may be rigid. Suitable materials for rigid walls include HDPE and PP.

The opening 18 may intercept both the top wall 30 and one of the other walls 30 of the package 10, so that the sheets 14 may be dispensed in either a pop-up manner or a reach-in manner. A suitable package 10 and opening 18 may be made in accordance with the teachings of commonly assigned U.S. Pat. No. 4,623,074 issued Nov. 18, 1986 to Dearwester or U.S. Pat. No. 5,516,001 issued May 14, 1996 to Muchenfuhs et al.

The opening 18 may comprise any variety of shapes, and intercept one or more walls of the package 10. The walls may be discrete and defined from one another, and have a major depth M. Suitable material for the walls include HDPE and PP. The major depth is parallel to and may be measured coincident a major axis, which is generally the longest dimension intercepted by the package 10. The major depth M of the package 10 may be vertical if the opening 18 is on the upper surface of the package 10 when the package 10 is placed on a horizontal surface or reference plane such as a table or countertop. Such a package 10 may have a primary dispensing direction generally parallel to the major axis.

The opening 18 need not be juxtaposed with a particular edge of the package 10. The opening 18 may be juxtaposed with the shorter edge of the package 10, a corner thereof, or in any other suitable configuration, including the front, back, or side walls 30.

The opening 18 may be covered by a lid 22. The lid 22 may be juxtaposed with the opening 18, in a closed position and removed from the proximity of the opening 18 and an open position. The lid 22 may be hingedly attached to the package 10, particularly the body 11. If so, one or more hinges 24 may join the body 11 and lid 22 so that one that may move relative to the other by articulation. Alternatively, the lid 22 may be totally removable from the body 11, and not attached by hinges 24 or other means.

The package 10 may have a circular or noncircular cross section. Exemplary non-circular cross sections include squares, ovals, rectangles and other cross sections having an aspect ratio not equal to unity. A noncircular cross-section provides the benefit that a flat surface may be presented to someone looking at the package 10. This arrangement provides the benefit that a label, advertising, instructions, graphics or other indicia may be placed on the flat surface and provide a billboard effect to the viewer. Furthermore, if the package 10 having a noncircular cross section is dropped on its side, such a package 10 will not roll.

If a generally parallelepipedally shaped package 10 is selected, the hinges 24 may be generally horizontally disposed when the package sits on in a counter or table. If the opening 18 is at the top of the package 10, the axis of the hinge 24 may be generally perpendicular to the primary dispensing direction.

Figure 2:
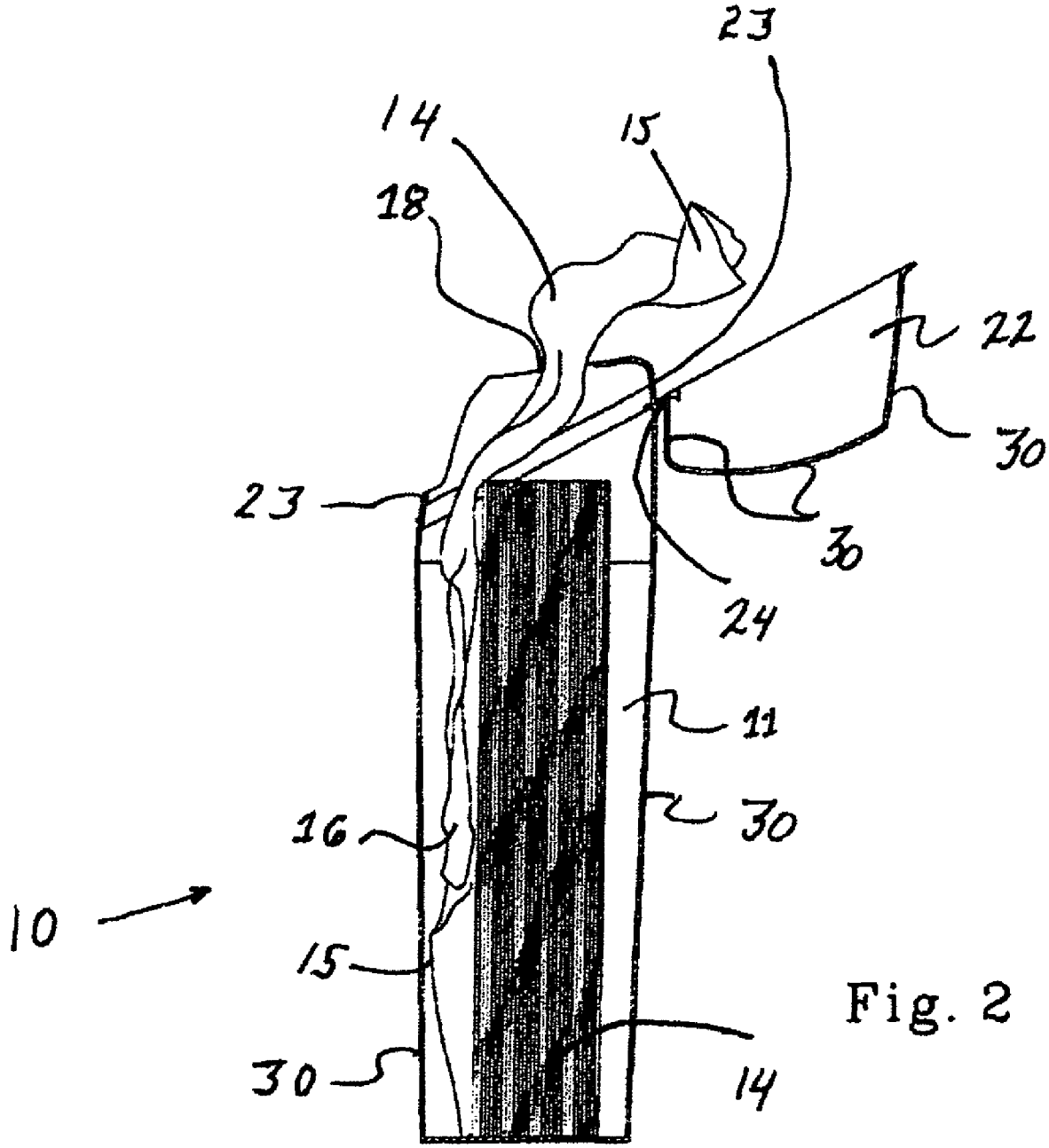
FIG. 2 is a vertical sectional view taken a long line 2-2 of FIG. 1.

Referring to FIG. 2, the hinge 24 may be disposed on one of the long sides or one of the short sides of a package 10 having a generally rectangular cross section. While a package 10 having two hinges 24 equally spaced from the sides is shown, the invention is not so limited. A package 10 having a single hinge 24, two hinges 24 or three or more hinges 24 may be utilized. The hinges 24 may be collinear and of equal or unequal length, spacing, etc.

The hinge 24 may be a living hinge 24. A living hinge 24 may be made of a single piece of material, integrally joined to both the body 11 and lid 22. The living hinge 24 may have a region of reduced thickness, about which the articulation occurs and they thereby defines the axis of the hinge 24. Alternatively, the hinge 24 may be a hook-and-eye configuration, a piano hinge 24, a butt hinge 24 or any other configuration, which allows articulation between the body 11 and lid 22.

Alternatively, the lid 22 may be completely detachable from the body 11. In such an embodiment the lid 22 may be removably joined to the body 11. In such an embodiment, the lid 22 may be joined to the body 11 upon closure by the interference fit around the periphery.

The lid 22 and body 11 may be joined at an interference that when the lid is in the closed position. An interference fit occurs when the material of either the lid 22 or body 11 slightly displaces the material of the other upon closure of the lid 22. Such displacement may be elastic, due to the resilient material properties of the lid 22 and/or body 11. The body 11 may have a periphery 23, about which the lid 22 fits upon closure. Alternatively, the lid 22 may fit inside the periphery 23 of the body 11 upon closure.

The periphery 23 may be generally perpendicular to the major axis of the package 10. Alternatively, the periphery 23 may be disposed in acute angular relationship relative to the major axis of the package 10, as shown. The opening 18 may be disposed within the boundary of the periphery 23.

The periphery 23 may have a sealing surface which is generally parallel to the major axis of the package 10. The sealing surface may avoid a snap or locking engagement, such as may occur with if an undercut is present. Therefore the sealing surface may be smooth and be provided without an undercut. For the package 10 described herein, a sealing surface having a dimension of about 3 to about 7 mm, particularly about 5 mm, taken parallel to the major axis may be suitable.

The interference fit provides a seal between the body 11 and lid 22. By seal it is meant that a barrier to evaporation or the transfer of gas into or out of the package 10 is present. The seal may also prevent intrusion of contamination into the package 10, providing for sanitary and hygienic storage of the contents. The seal may also prevent intrusion of oxygen, air, etc. into the package 10.

The interference fit may be quantified by the amount of deformation or overlap which occurs between the body 11 and lid 22 upon closure. In the embodiment shown, the interference is measured radially, generally perpendicular to the periphery 23 at any point. The radial measurement is taken generally perpendicular to the major axis of the package 10.

Figure 3:
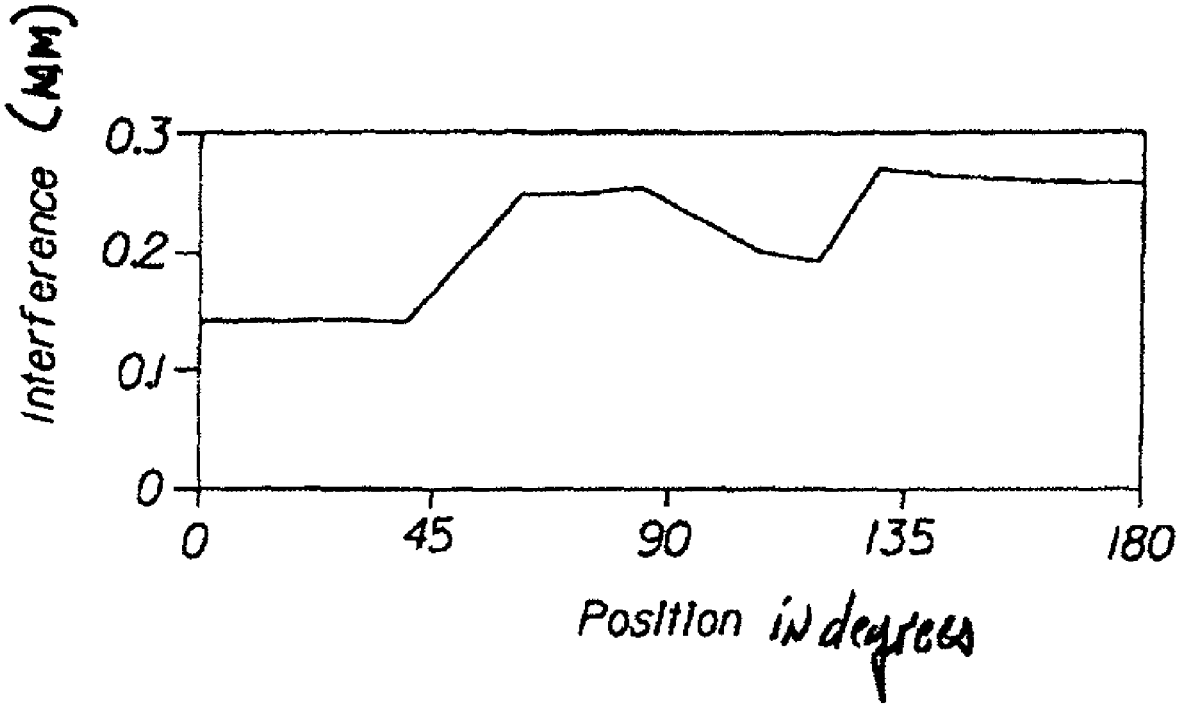
FIG. 3 is a graphical representation of the relationship between the azimuthal position of the periphery of the package and the amount of interference present at that position, with the 0 degree position representing the point on the periphery centered between the hinges, the 90 degree position representing the center of the short sidewall and the 180 degree position representing the center of the package as viewed from the front.
Figure 4A:
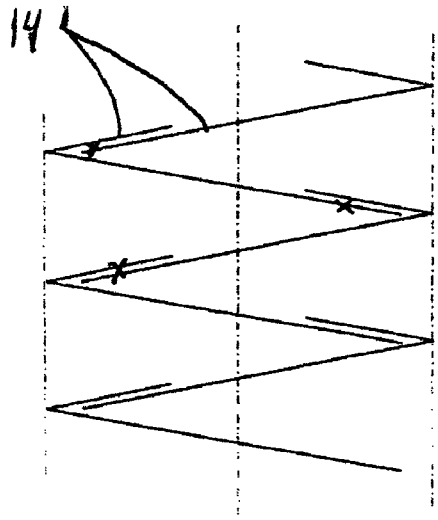
FIGS. 4A-4E are schematic side views of exemplary, representative interleave patterns.
Figure 4B:
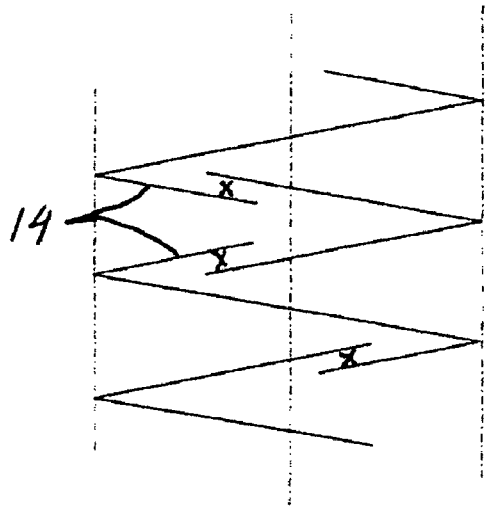
Figure 4C:
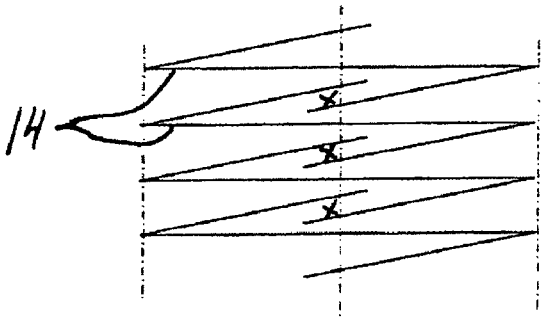
Figure 4D:
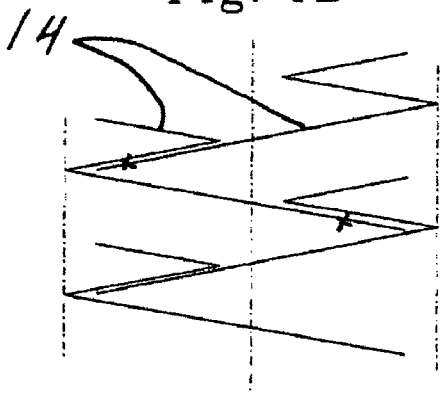
Figure 4E:
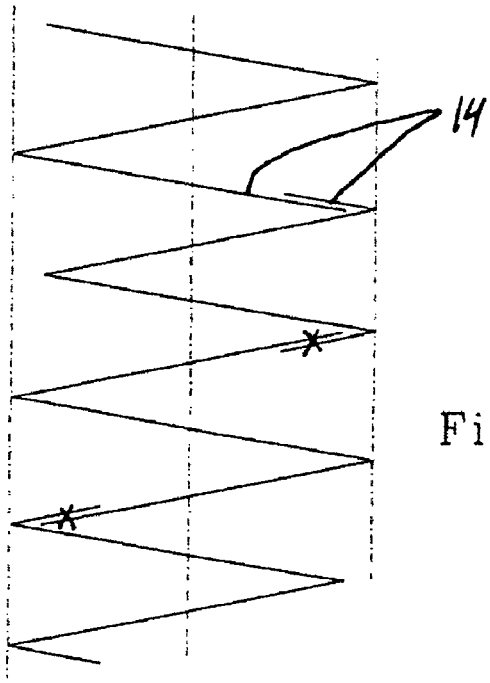
Figure 5A:
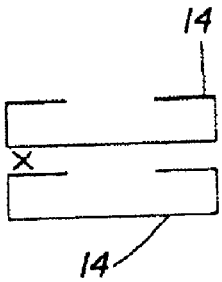
FIGS. 5A-5E are schematic side views of exemplary, representative non-interleave patterns.
Figure 5B:
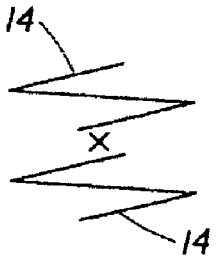
Figure 5C:
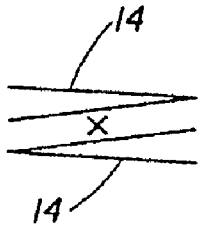
Figure 5D:
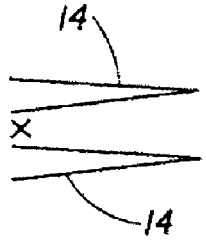
Figure 5E:
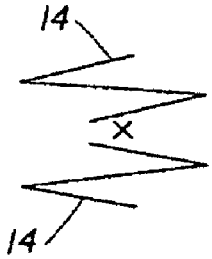

Referring to FIG. 3, the amount of interference may be of a first dimension throughout a first portion of the periphery 23. In one embodiment, the first portion of the periphery 23 is that portion of the periphery 23 which does not correspond in circumferential position to any of the hinges 24. For the embodiment shown, having a generally rectangular cross section with dimensions of approximately 100 millimeters and 52 mm, the interference at the first portion may range from about 0.15 to about 0.35 mm, and particularly be about 0.25 mm.

The amount of interference may be of a second dimension throughout a second portion of the periphery 23. The second portion of the periphery 23 is that portion of the periphery 23 which corresponds in circumferential position to any of the hinges 24. For the embodiment shown, having a generally rectangular cross section with dimensions of approximately 100 millimeters and 52 mm, the interference at the second portion may range from about 0.10 to about 0.20 mm, and particularly be about 0.15 mm.

The amount of interference at the second portion is less than the amount of interference at the first portion. Generally, the interference at the second portion of the periphery may be greater than zero, although an interference of zero may be suitable for the second portion. Likewise, if a relatively short portion of the periphery 23 is disposed between two hinges 24, such portion of the periphery may also have the lesser amount of interference fit imparted to the second portion of the periphery 23.

As illustrated by the foregoing example, the second dimension is less than the first dimension. This relative proportion minimizes the amount of tension or other radial forces imparted by the hinges 24, to the seal. By minimizing such tension or other radial forces a more uniform compression can be exerted throughout all circumferential positions of the seal. This arrangement provides a more stable and uniform seal, minimizing evaporation of moist or wet contents from the body 11 of the package 10.

In another embodiment, the second portion of the periphery 23 may be that portion of the periphery 23 which is juxtaposed with the corners. Since the corners are inherently more rigid than the planar portions of the walls 30, the interference may be less at the corners and an adequate seal still occur. Similarly, the interference may be less at the shorter walls 30 than the longer walls 30. The shorter walls 30 are inherently stiffer than longer walls 30 of like thickness, therefore making it feasible to have a greater interference for the longer walls 30 than shorter walls 30.

This arrangement provides the benefit that a noncircular periphery 23 may be employed. A noncircular periphery has differential stresses, due to the asymmetry inherent with the short sides and long sides of the seal. By minimizing differences in the stress field around a noncircular periphery 23, a more uniform seal can be obtained for and throughout the noncircular periphery 23. A noncircular periphery 23 may be particularly advantageous with a package 10 having a noncircular cross-section. As noted above, a package 10 having a noncircular cross-section provides the benefit of a flat surface, which is more readily seen by someone looking at the package 10.

While the interference provides a friction fit between the body 11 and a lid 22, the package 10 may further comprise a closure. The closure may be any device, which impedes opening of the way of 11 when it is in the closed position. Suitable closures include snaps, various seals, hook and loop fasteners, latches, etc.

The package 10 may be disposable or refillable. By "disposable" is meant the package 10 is intended to be discarded after the contents supplied therewith are depleted. Such a package 10 is not intended to be restocked with articles. Likewise, each sheet 14 or other article placed in the package 10 may be discarded after a single use, and not laundered or otherwise restored. By "refillable" it is meant the package 10 is or may be restocked with articles after the supply is depleted. Such sheets 14, or other articles, may be disposable or reusable.

If desired, wet or moist sheets 14 may be packaged in a flow wrap, as is known in the art. A flow wrap is a polymeric film or other type of impervious wrapper which can be used to cover sheets 14 or articles, as desired. The flow wrap may be used to prevent evaporation of moisture of the articles contained therein, may be used to keep the articles hygienic and sanitary until ready for use.

Flow wrap may generally conform to the shape of the articles contained therein. If the articles comprise a clip or magazine of sheets 14, the flow wrap may comprise a generally parallelepiped geometry. The flow wrap may have an opening, allowing the user to access the contents therein or dispense the contents therethrough. The opening may be disposed on any side or position of the flow wrap, including without limitation the short sides, long sides, intermediate sides, etc.

The package 10 may contain articles, such as discrete sheets 14 to be dispensed. Suitable sheets 14 may be made according to commonly assigned U.S. Pat. No. 4,191,609 issued Mar. 4, 1980 to Trokhan, U.S. Pat. No. 4,637,859 issued Jan. 20, 1987 to Trokhan, or U.S. Pat. No. 5,332,118 issued Jul. 26, 1994 to Muckenfuhs. The sheets 14 may comprise natural fibers, manmade fibers, cellulosic materials, recycled materials, biodegradable materials, films, synthetic nonwovens, or combinations thereof. The sheets 14 may be wet, moist or dry. One skilled in the art will recognize that the package 10 may be water impervious if the sheets 14 are wet. Wetting enables the sheets 14 to be used for wiping the skin as, for example, upon removal of a soiled diaper or to remove soiling from a hard surface such as a countertop. Of course, it will be apparent at various additives such as perfumes, antibacterial agents, cleansers, etc. may be utilized with a lead a sheet 14.

A sheet 14 may be considered to have been "dispensed through" the opening 18 when it passes at least partially from inside the package 10 to outside the package 10, either due to the consumer reaching in and grasping the sheet 14, or the sheet 14 popping up through the opening 18, by trailing the sheet 14 previously withdrawn by the user. A sheet 14 may be considered to be "withdrawn" after it has passed completely from inside the opening 18 to outside the opening 18, and no portion or edge of the sheet 14 remains within the package 10.

The opening 18 may be of a first size relative to the sheets 14. This first size may be designed to constrict the sheets 14 as they are pulled through the opening 18 by the user. Sheets 14 are considered to be "constricted" when they must touch the walls 30 intercepted by the opening 18 upon withdrawal by the user.

The sheets may be sequentially dispensed through the opening 18 by popup dispensing. In such sequential dispensing, each sheet 14 may be releasably attached to two adjacent sheets 14 by any releasable attachment which allows easy separation to occur as the sheet 14 is being dispensed or after the sheet 14 is withdrawn through the opening 18. The releasable attachment should allow one sheet 14 to be readily separated from an adjacent or subsequent sheet 14, without undue stresses being applied, tearing of either sheet 14, or damage to the opening 18 or other portions of the package 10.

Each sheet 14 may be releasably attached to an adjacent sheet 14 at a lap seal or a fin seal. The separation forces typically applied during dispensing to a lap seal, may be in shear. The separation forces typically applied during dispensing to a fin may be in peel. It will be apparent to one skilled in the art that the seal joining adjacent sheets 14 must be strong enough to pull the succeeding sheet 14 through the opening 18, yet allow the sheets 14 to be easily separable at the point of use. In either arrangement, the lap or fin seal may comprise both bonded areas and free areas. Having both bonded areas and free areas in the seal may be important for controlling the separation forces and how the leading edge 15 of the sheet 14 is exposed before separation from the succeeding sheet 14.

While rectangular sheets 14 are common in the art, one of skill will recognize that the invention is not so limited. The sheets 14 may be of any size, shape and thickness which are suitable for the intended use and can be conveniently dispensed as described herein.

The releasable attachment may comprise adhesively joining one sheet 14 to adjacent sheets 14 with skin friendly adhesive, lotion compatible adhesive, or FDA approved adhesive, as desired. A suitable adhesive may be supplied by Findley Adhesives Inc. of Wauwatosa, Wis. as Item No. H9087-05 or by H. B. Fuller of St. Paul, Minn. as Product Code HZ-1620-B-ZP.

In order to save material costs, other releasable attachments may be utilized. For example, fusion bonded releasable attachments, such as ultrasonic welding or heat sealing of adjacent sheets 14 may be employed, as is well known in the art. Additionally, mechanical entanglement releasable attachments, such as needle punching, steam sealing, embossing, or crimping may be utilized as well. Autogeneous bonding releasable attachments, such as disclosed in commonly assigned U.S. Pat. No. 4,854,984 issued Aug. 8, 1989 to Ball et al. may be utilized.

It will further be apparent that wetted sheets 14 may be releasably attached to one another through cohesion at the overlap between adjacent sheets 14. The cohesion may not require an affirmative manufacturing step and may be used to augment other releasable attachments.

Alternatively, a sheet 14 may be releasably attached to an adjacent sheet 14 by a plurality of frangible lands. As used herein a "land" refers to a small connection separated by large cuts and joining adjacent sheets 14. Lands may be considered to be "frangible" if, upon separation of one sheet 14 from an adjacent sheet 14 in tension, the lands 18 break prior to significant ripping or tearing of either sheet 14. This arrangement allows perforated sheets 14 to be utilized. Of course, multiple releasable attachments may be used in any combination.

If the package 10 contains sheets 14 to be dispensed, the major depth M of the package 10 may be considered relative to the breaking strength of a releasable attachment between adjacent sheets 14. The releasable attachment may be overcome by the weight of the sheet 14 between a free-hanging releasable attachment means and the magazine of sheets 14 therebelow. As the package 10 becomes taller in the vertical direction, and the weight of a free hanging sheet 14 increases, the opening 18 must become more restrictive to prevent the sheet 14 to be dispensed from falling back into the package 10. Furthermore, as the sheets 14 become thicker, the area of the opening 18 should increase to allow the sheets 14 to be dispensed therethrough.

Each sheet 14 may have a leading edge 15 and a trailing edge 16. The leading edge 15 is that edge of the sheet, which is generally first drawn through the opening 18 during dispensing. The trailing edge 16 is generally the last portion of the sheet 15 withdrawn through the opening 18 during dispensing.

The trailing edge 16 of one sheet 14 may be releasably attached to the leading edge 15 of a subsequent sheet 14. This arrangement allows the trailing edge 16 of the first sheet 14 to be dispensed to pull the leading edge 16 of the subsequent sheet 14 through the opening 18. The releasable attachment of successive trailing edges 16 and leading edges 15 provides for sequential dispensing of the respective sheets 14.

Referring to FIGS. 4A-4E, the sheets 14 may be disposed in a package 10 in an interleaved pattern. A pattern is considered to be "interleaved" when part of a sheet 14 is behind the succeeding sheet 14 to be dispensed while the sheets 14 are disposed in that pattern prior to dispensing through opening 18. Thus, in an interleaved pattern of sheets 14 according to the present invention, pop-up dispensing may be assisted by frictional engagement between adjacent sheets 14. The interleaved pattern may be assisted in maintaining popup dispensing through the addition of a releasable attachment, as discussed above. Such a releasable attachment may be disposed at the position marked with the "X."

Referring to FIGS. 5A-5E, the sheets 14 may be disposed in a package 10 in a non-interleaved pattern. A pattern is considered to be "non-interleaved" when no part of a sheet 14 is behind the succeeding sheet 14 to be dispensed while the sheets 14 are disposed in the pattern prior to dispensing through opening 18. Thus, in a non-interleaved pattern of sheets 14 according to the present invention, pop-up dispensing does not have to rely upon frictional engagement between adjacent sheets 14. Again, a releasable attachment may be utilized, as discussed above.

In either an interleaved pattern or a non-interleaved pattern, the sheets 14 may be generally disposed in a stack. Thus, interleaved and non-interleaved patterns are collectively referred to as stacked patterns, as both such patterns yield a stack of the sheets 14.

One of skill will recognize that a single interleave or non-interleave arrangement may be used in a particular stack or clip of sheets 14. Alternatively a given stack of sheets 14 may have plural interleave patterns, non-interleave patterns, or combinations thereof. This arrangement can be used to accommodate different empty volumes of the body 11 as more sheets 14 are dispensed or to accommodate the first sheet 14, as desired.

The stack may be generally flat, and parallelepipedally shaped. Each sheet 14 in the stack may be folded into a configuration having a footprint which is smaller than the unfolded dimensions of the sheet 14. For example, if the sheet 14 is rectangularly shaped, the footprint of the stack may likewise be rectangularly shaped. However, either or both dimensions of the stack may be smaller than the corresponding dimension of the unfolded sheet 14. This arrangement provides a stack with a relatively smaller footprint, and which can fit in to the body 11 of the package 10.

Each sheet 14 in the stack may define a plane due to the folding pattern. That plane may be generally parallel to the major axis of the package 10, and to the dispensing direction. This geometry provides the benefit that a package 10 of noncircular cross-section, and having the opening 18 on a small side of that package may be provided with a relatively smaller footprint. Such a geometry may also yield a package 10 having a relatively larger side facing the user and providing the aforementioned billboard effect.

The sheets 14 need not be disposed in a flat plane as shown. If desired, the sheets 14 may be disposed in a curvilinear plane. For example, the sheets 14 may assume a curve having an S-shape or a shape with a bend at the bottom of the body 11 of the package 10. Such a geometry may improve the ability of the sheets 14 to stand in the vertical plane, if a vertical footprint is desired for the package 10. Such a geometry may also assist in maintaining alignment of the plane of the sheets parallel to the major axis of the package 10 and hence parallel to the primary direction of dispensing of the sheets 14 through the opening 18.

Alternatively, the sheets 14 may be disposed in a package 10 in a spiral wound pattern. A pattern is considered to be spiral wound when the sheets 14 are disposed in a volute pattern prior to dispensing through opening 18. In such a configuration the sheets 14 may be rolled into a core, providing a spool of sheets 14 to be dispensed, or may be roll A spiral wound pattern is common with packages 10 having a circular cross-section.

Figure 6:
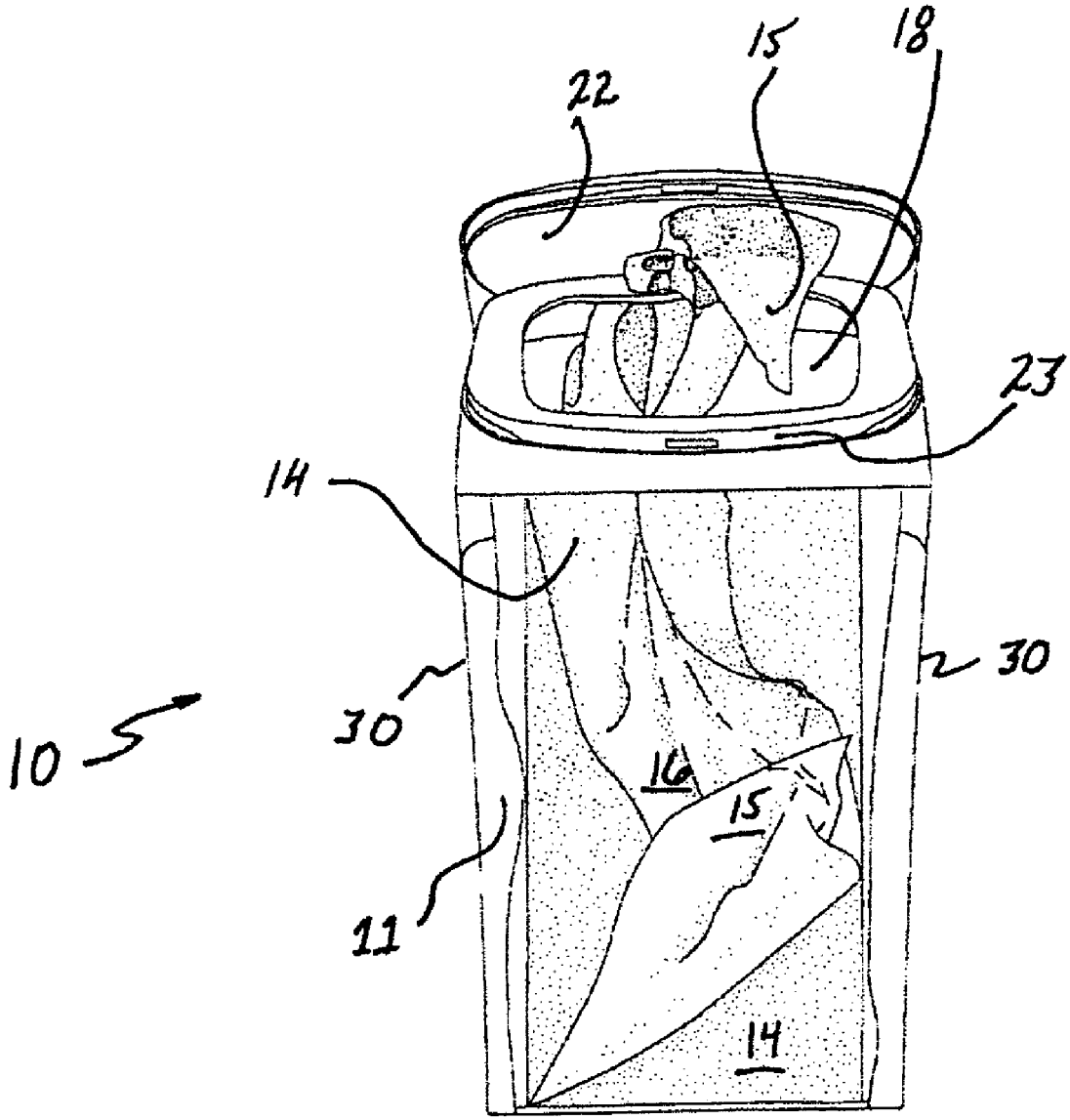
FIG. 6 is a frontal view of a stack of sheets showing the inversion of the leading edge upon dispensing, the stack being in an exemplary package shown in cutaway.

Referring to FIG. 6, if desired the leading edge 15 of the sheet 14 may be disposed away from opening 18. This geometry provides a sheet 14, with the trailing edge 16 of that sheet 14 closer to the opening 18 than the leading edge 15 of that sheet 14 prior to dispensing. In such an embodiment, the sheet 14 inverts or reverses position during dispensing. This allows the sheet 14 to begin unfolding prior to dispensing through the opening 18. By inversion it is meant that the leading edge 15 of the sheet 14 being dispensed travels back across that sheet 14 as the leading edge 15 is pulled from a position remote from the dispensing opening 18 towards the opening 18. During dispensing, the leading edge 15 of the sheet 14 that was disposed remote from opening 18 moves within the body 11 towards the opening 18 due to the withdrawal of the preceding sheet 14.

Additionally, the sheets 14 may invert in the other plane. This allows the sheet 14 to unfold across the vertical axis, or such other axis as may be aligned with the dispensing direction. Such a geometry allows the sheet 14 to invert in two generally orthogonal planes. This arrangement provides the benefit that the sheet 14 may be less prone to tearing upon dispensing and that it may more easily unfold for use after dispensing.

If such an arrangement is elected, the body 11 of the package 10 may be provided with sufficient space to allow the sheet 14 to begin inversion and unfolding as the leading edge 15 reverses position from a position distal relative to opening 18 to a position proximal opening 18. This may be particularly desirable if one is concerned with tearing of the first sheet 14 to be dispensed.

One of skill will recognize that the first sheet 14 to be dispensed may not encounter the inversion discussed above. This is due to the convenience of having the first leading edge 15 disposed in proximity to the opening 18, in order to easily start the dispensing process.

A sheet 14 dispensed according to the present invention may have a single peak in the dispensing force, as the sheet 14 is withdrawn through the opening 18. This single peak is illustrated by a single inflection point in the load-deflection curve as the sheet 14 is dispensed. This arrangement may provide more uniform and comfortable dispensing experience to the user.

While a package 10 having a lid 22 disposed above the body 11 is illustrated, the invention is not so limited. The lid 22 may be placed proximal to the dispensing opening 18. The dispensing opening 18 need not be juxtaposed with the top of the package 10 as illustrated. The dispensing opening 18 may be placed central to the package 10, or juxtaposed with the bottom of the package 10 as desired.

The sheets 14 may be inserted into the package 10 in a dry condition. If desired a wetting solution may later be added to the package, and allowed to equilibrate or generally diffuse through the sheets 14. This arrangement provides the benefit that the sheets 14 can be manufactured and packaged in a dry condition, but presented to the consumer in a wet condition. If the solution migrates to the bottom of a generally vertical package and dispensing may occur prior to full equilibration of the solution. If so, during the inverted dispensing described herein, some transfer of that solution to the top portions of the sheets 14 can be expected to occur. Such transfer may yield a more uniform distribution of the solution to the sheets 14.

What is claimed is:

1. A container comprising:

a body for containing a product therein, said body having an opening defined by a periphery;

a lid hingedly attached to said body by at least one hinge, said lid being openable and closable by articulation of said hinge;

said lid having an interference fit with said body throughout said periphery, wherein one can fit inside the other to effect an evaporative barrier seal throughout said periphery when said lid is closed, said interference fit being of a first radial dimension substantially throughout a first portion of said periphery not corresponding to said at least one hinge, said interference fit being of a second radial dimension substantially throughout a second portion of said periphery corresponding to said at least one hinge, said second radial dimension being less than said first radial dimension, whereby said evaporative barrier seal extends around said periphery upon closing said lid.

2. A container according to claim 1 wherein said lid is outside said periphery of said body upon closing said lid.

3. A container according to claim 2 wherein said body and said lid have a noncircular cross section.

4. A container according to claim 3 wherein the periphery of said body compresses radially inwardly a first radial dimension at said first portion upon closure of said lid, and said periphery compresses radially inwardly a second radial dimension at said second portion upon closure of said lid, said second radial dimension being less than said first radial dimension.

5. A container according to claim 3 having at least one hinge connected to said body and said lid, said periphery of said body having a generally rectangular cross section with two major sides and two minor sides, said at least one hinge being disposed on a said major side of side periphery.

6. A container comprising:

a body for containing a product therein, said body having an opening defined by a noncircular periphery;

a lid hingedly attached to said body by at least one hinge, said lid being openable and closable by articulation of said hinge;

said lid having an interference fit with said body throughout said periphery, wherein one can fit inside the other to effect an evaporative barrier seal throughout said periphery when said lid is closed, said interference fit being of a first radial dimension substantially throughout a first portion of said periphery not corresponding to said at least one hinge, said interference fit being of a second radial dimension substantially throughout a second portion of said periphery corresponding to said at least one hinge, said second radial dimension being less than said first radial dimension, whereby said evaporative barrier seal extends around said periphery upon closing said lid.

7. A container according to claim 6 wherein said periphery has at least one major dimension and at least one minor dimension, said container having at least one hinge disposed on said major dimension of said periphery.

8. A container according to claim 7 comprising at least two hinges disposed collinear to one another.

9. A container according to claim 8 wherein said hinges are living hinges.

10. A container according to claim 9 wherein said body and said lid have a smooth seal without a undercut.

11. A container according to claim 10 wherein said lid has a periphery and said body is graduated at said periphery, wherein said lid has a first wall thickness and said lid periphery has a second wall thickness, said first wall thickness being greater than said second wall thickness.

12. A container according to claim 6 having a major axis and a cross section perpendicular thereto, said periphery lying noncoincident with a cross section.

13. A container according to claim 12 wherein said periphery defines a plane, said plane being disposed in acute, nonperpendicular angular relationship relative to said major axis.

14. A container comprising:

a body for containing a product therein, said body having an opening defined by a periphery;

a lid removably attachable to said body;

said lid having an interference fit with said body throughout said periphery, wherein one can fit inside the other to effect an evaporative barrier seal throughout said periphery when said lid is closed, said interference fit being of a first radial dimension substantially throughout a first portion of said periphery, said interference fit being of a second radial dimension substantially throughout a second portion of said periphery, said second radial dimension being less than said first radial dimension, whereby said evaporative barrier seal extends around said periphery upon closing said lid.

15. A container according to claim 14 wherein said body has a non-circular cross section.

16. A container according to claim 15 having a rectangular cross section with four corners, two shorter sides and two longer sides.

17. A container according to claim 15 wherein said second portion of said periphery is juxtaposed with corners.

18. A container according to claim 16 wherein said second portion of said periphery is juxtaposed with said two shorter sides.

19. A container according to claim 15 wherein said periphery has a noncircular cross section.

* * * * *